US006227676B1

(12) United States Patent
Sneddon

(10) Patent No.: US 6,227,676 B1
(45) Date of Patent: May 8, 2001

(54) METHOD AND APPARATUS FOR SHAVING

(76) Inventor: Lynn Sneddon, 193 Queen Anne Dr., Williamstown, NJ (US) 08094

( * ) Notice: Subject to any disclaimer, the term of this patent is extended or adjusted under 35 U.S.C. 154(b) by 0 days.

(21) Appl. No.: 09/468,756

(22) Filed: Dec. 21, 1999

(51) Int. Cl.[7] ..... B26B 19/46; B26B 21/46

(52) U.S. Cl. ..... 362/115; 362/109; 362/84; 362/253; 424/115; 30/34.05; 30/537; 250/459.1; 250/461.4

(58) Field of Search ..... 362/115, 109, 362/84, 253; 424/115; 30/34.05, 537; 250/459.1, 461.4

(56) References Cited

U.S. PATENT DOCUMENTS

| | | | | |
|---|---|---|---|---|
| 3,770,950 | | 11/1973 | Brenneman et al. | 240/2 BB |
| 4,094,062 | | 6/1978 | Papanikolaou | 30/34 R |
| 4,473,943 | | 10/1984 | Papanikolaou | 30/34 R |
| 4,994,946 | * | 2/1991 | NakaMats | 362/282 |
| 5,299,104 | | 3/1994 | Parmentier | 362/115 |
| 5,415,151 | * | 5/1995 | Fusi | 124/56 |
| 5,582,476 | | 12/1996 | Hansen | 362/115 |

* cited by examiner

*Primary Examiner*—Sandra O'Shea
*Assistant Examiner*—Ali Alavi
(74) *Attorney, Agent, or Firm*—Henderson & Sturm LL

(57) ABSTRACT

A method and apparatus (10) for facilitating the shaving of large body surfaces. The method employs a skin lubricating unit (12) in the form of a shaving gel (41) impregnated with a luminous agent such as "Luminal" that will penetrate the user's body hairs wherever the foaming gel (41) is applied such that a razor blade member (20) equipped with a black light element (30) disposed in proximity to the shaving blade cartridge (24) will cause any body hairs missed in the shaving process to glow under the combined effects of the "Luminal" and the black light to insure that the selected body surfaces are completely shaved.

12 Claims, 1 Drawing Sheet

METHOD AND APPARATUS FOR SHAVING

BACKGROUND OF THE INVENTION

1. Field of the Invention

The present invention relates to the field of illuminated shaving razors in general, and in particular to a method of using an illuminated shaving razor in combination with a luminous shaving gel.

2. Description of Related Art

As can be seen by reference to the following U.S. Pat. Nos. 3,770,950; 4,094,062; 4,473,943; 5,299,104; and 5,582,476, the prior art is replete with myriad and diverse illuminated shaving razor constructions.

While all of the aforementioned prior art constructions are more than adequate for the basic purpose and function for which they have been specifically designed, they are uniformly deficient with respect to their failure to provide a simple, efficient, and practical method of insuring that all of the desired body portions that are to be shaved are shaved completely.

As most women are aware, the task of shaving their legs is complicated by the large surface area that must be covered during the shaving process and the fact that unless extreme care is taken, there will be small areas that will invariable be missed even after fairly vigilant visual observation.

As a consequence of the foregoing situation, there has existed a longstanding need for a new and improved method and apparatus for shaving wherein the presence of any hair in unshaved portions is readily visible to the person practicing the method, and the provision of such a method and apparatus are the stated objective of the present invention.

BRIEF SUMMARY OF THE INVENTION

Briefly stated, the method and apparatus that forms the basis of the present invention comprises in general, a shaving unit and a skin lubricating unit. The shaving unit includes a shaving razor member provided with a black light element and the skin lubricating unit includes a luminous gel that is to be applied to the body areas that are to be shaved.

As will be explained in greater detail further on in the specification, the black light element is disposed on the angled upper end of the shaving razor member, such that the black light element projects black light over the selected body areas that are to be shaved.

Once the user has applied the skin lubricating unit over the selected body areas, the luminous gel will penetrate those body hairs that project above the skin surface.

As a consequence, as the razor blade member passes back and forth over a selected portion of a user's body, all of the unshaven body hairs will be brought into stark visual relief as the black light falls upon the unshaven hairs that have been impregnated by the luminous agent.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
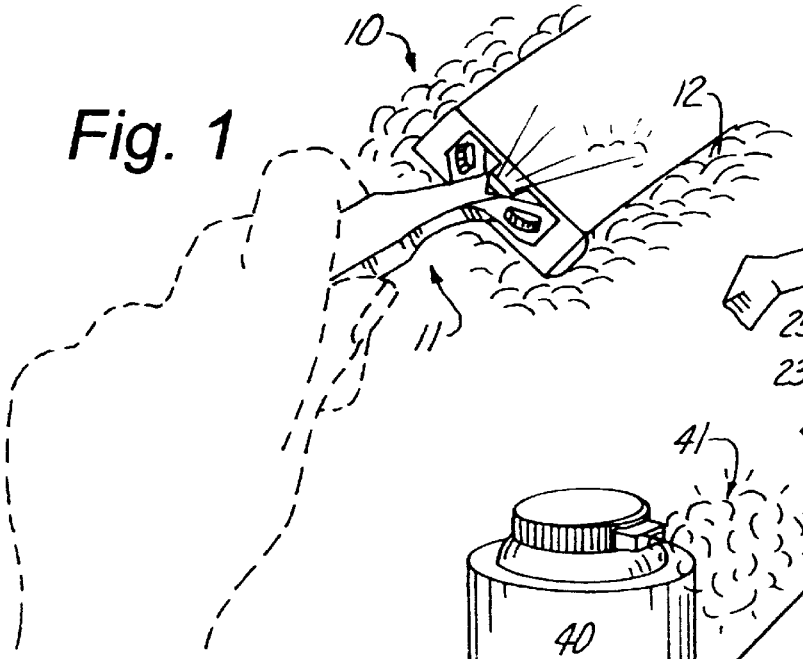
FIG. 1 is a perspective view of the illuminated razor unit in use with the luminous shaving gel.

As can be seen by reference to the drawings, and in particular to FIG. 1, the apparatus that forms the basis of the present invention is designated generally by the reference number 10. The apparatus 10 comprises in general, an illuminated razor unit 11 and a skin lubricating unit 11. These units will now be described in seriatim fashion.

Figure 4:
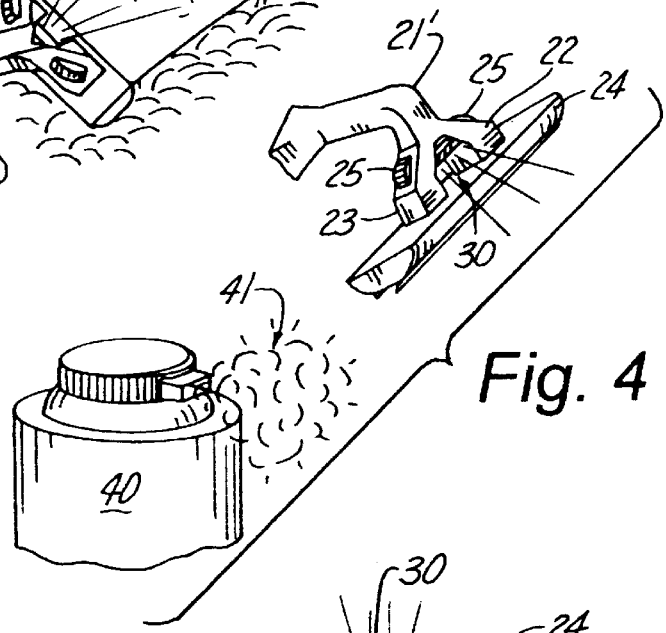
FIG. 4 is a partial side by side view of portions of the razor unit and the luminous gel dispensing unit.
Figure 2:
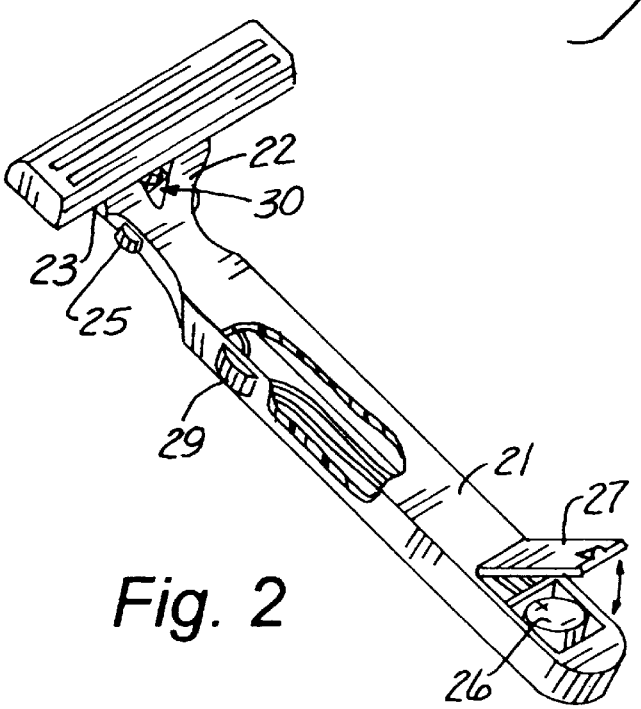
FIG. 2 is a partial front cutaway view of the razor unit.
Figure 3:
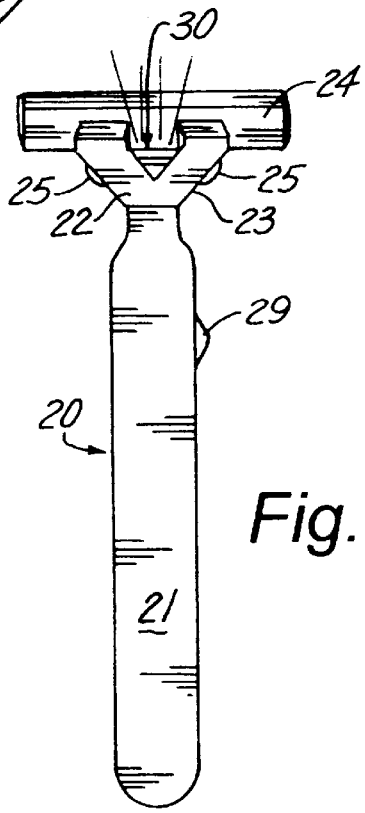
FIG. 3 is a rear elevation view of the razor unit.

As can best be seen by reference to FIGS. 2 through 4, the illuminated razor unit 11 includes a shaving razor member 20 having an elongated hollow handle portion 21 whose angled upper end 21' terminates in a pair of bifurcated support arms 22, 23 which are adapted to releasably engage a replaceable razor blade cartridge 24 via a pair of push button release element 25.

In addition, a miniature black light element 30 is disposed across the pair of bifurcated arms 22, 23 and positioned such that the black light will shine both through the gap between the support arms 22, 23 as well as above the angled razor blade cartridge 24 for reasons that will be explained presently.

Furthermore, as shown in FIG. 2, the hollow handle portion 21 of the shaving razor member 20 is provided with a replaceable battery power source 26 which is accessed by a hinged panel 27. The power source 26 is connected by electrical wires 28 to the black light element 30 and the flow of electrical current between the black light element 30 and the power source 26 is controlled by an on off switch 29.

Turning now to FIGS. 1 and 4, it can be seen that the skin lubricating unit 12 comprises a luminous foaming gel 41 packaged in a conventional shaving gel container 40. The gel 41 is impregnated with a luminous agent such as "Luminal" which will penetrate the person's body hair prior to shaving such that when the user activates the black light element 30 during the shaving process, the black light will cause the Luminal impregnated hairs to glow so that the user can quickly visually determine what areas on their bodies have not been properly shaved.

As a consequence of the foregoing situation, the method and apparatus 10 of this invention virtually insures that it will be almost impossible for a woman to miss any areas of body hair that she wishes to remove during the shaving process.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A method of shaving selected portions of a user's body comprising the steps of:

(a) coating the selected portions of the user's body with a shaving gel containing a luminous agent;

(b) allowing the luminous component to impregnate the body hairs in the selected portions of the user's body;

(c) illuminating the selected portions with a black light element; and (d) shaving the selected portions with a razor blade member.

2. The method as in claim 1 wherein the black light element is carried by the razor blade member.

3. The method as in claim 2 wherein the black light is focused forwardly along the line of travel of the razor blade member.

4. The method as in claim 2 wherein the black light is focused rearwardly along the line of travel of the razor blade member.

5. The method as in claim 2 wherein the black light is focused both forwardly and rearwardly along the line of travel of the razor blade member.

6. An apparatus for shaving selected portions of a user's body comprising the combination of:

a shaving razor member having an elongated handle portion and a replaceable razor blade cartridge; and a black light element for illuminating said selected portions of a user's body; and shaving gel containing a luminous agent.

7. The apparatus as in claim 6 wherein said black light element is carried by said shaving razor member.

8. The apparatus as in claim 7 wherein the shaving razor member includes an elongated handle portion having an angled upper end which terminates in a pair of bifurcated support arms that are releasably engageable with a replaceable razor blade cartridge.

9. The apparatus as in claim 8 wherein the black light element is disposed intermediate the bifurcated support arms.

10. The apparatus as in claim 9 wherein the black light element projects black light forwardly along the line of travel of the razor blade member.

11. The apparatus as in claim 9 wherein the black light element projects black light rearwardly along the line of travel of the razor blade member.

12. The apparatus as in claim 9 wherein the black light element projects black light both forwardly and rearwardly along the line of travel of the razor blade member.

* * * * *